US012011134B2

(12) United States Patent
Snook et al.

(10) Patent No.: US 12,011,134 B2
(45) Date of Patent: Jun. 18, 2024

(54) WASHING APPARATUS INCLUDING CLOUD CONNECTED SPECTROMETER

(71) Applicant: Midea Group Co., Ltd., Foshan (CN)

(72) Inventors: Bryan T. Snook, Louisville, KY (US); Paul R. Staun, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 24 days.

(21) Appl. No.: 16/742,852

(22) Filed: Jan. 14, 2020

(65) Prior Publication Data

US 2021/0212549 A1 Jul. 15, 2021

(51) Int. Cl.

| | |
|---|---|
| ***A47L 15/42*** | (2006.01) |
| ***A47L 15/00*** | (2006.01) |
| ***D06F 33/32*** | (2020.01) |
| ***D06F 33/47*** | (2020.01) |
| ***D06F 33/52*** | (2020.01) |

(Continued)

(52) U.S. Cl.

CPC ..... *A47L 15/4297* (2013.01); *A47L 15/0028* (2013.01); *A47L 15/0055* (2013.01); *A47L 15/0063* (2013.01); *D06F 33/32* (2020.02); *D06F 33/47* (2020.02); *D06F 33/52* (2020.02); *D06F 34/05* (2020.02); *D06F 34/18* (2020.02); *D06F 34/22* (2020.02); *D06F 35/006* (2013.01); *A47L 2401/11* (2013.01); *A47L 2401/30* (2013.01); *A47L 2501/30* (2013.01); *D06F 2103/00* (2020.02); *D06F 2103/64* (2020.02); *D06F 2105/00* (2020.02); *D06F 2105/10* (2020.02); *D06F 2105/52* (2020.02)

(58) Field of Classification Search

CPC ..... A47L 15/4297; A47L 15/0028; A47L 15/0055; A47L 2401/11; A47L 2501/36; A47L 15/0021; A47L 2401/30; A47L 2501/30; A47L 15/0063; D06F 35/006; D06F 33/52; D06F 33/47; D06F 34/18; D06F 33/32; D06F 2103/00; D06F 2103/64; D06F 2105/10; D06F 2105/52; D06F 2105/00; D06F 34/22; D06F 34/05

See application file for complete search history.

(56) References Cited

U.S. PATENT DOCUMENTS

| | | | |
|---|---|---|---|
| 5,083,447 A | 1/1992 | Kiuchi et al. | |
| 6,784,997 B2 | 8/2004 | Lorenz et al. | |

(Continued)

FOREIGN PATENT DOCUMENTS

| | | | |
|---|---|---|---|
| DE | 102016211328 A1 * | 12/2017 | ..... D06F 33/32 |
| DE | 102017219806 A1 * | 5/2019 | ..... D06F 33/30 |

(Continued)

OTHER PUBLICATIONS

Virkhare, Neha et al., Neuro-Fuzzy Controller Based Washing Machine, International Journal of Engineering Science Invention, 2319-37, www.ijesi.org, vol. 3, Issue 1, pp. 48-51, Jan. 2014.

(Continued)

*Primary Examiner* — Joseph L. Perrin

(74) *Attorney, Agent, or Firm* — Gray Ice Higdon

(57) ABSTRACT

A washing apparatus (e.g. a laundry washing machine, dishwasher, etc.) and method configure a wash cycle in part based on spectral data obtained from a spectrometer positioned with the washing apparatus and analyzed in a remote cloud service.

17 Claims, 5 Drawing Sheets

(51) Int. Cl.

| | |
|---|---|
| ***D06F 34/05*** | (2020.01) |
| ***D06F 34/18*** | (2020.01) |
| ***D06F 34/22*** | (2020.01) |
| ***D06F 35/00*** | (2006.01) |
| *D06F 103/00* | (2020.01) |
| *D06F 103/64* | (2020.01) |
| *D06F 105/00* | (2020.01) |
| *D06F 105/10* | (2020.01) |
| *D06F 105/52* | (2020.01) |

(56) References Cited

U.S. PATENT DOCUMENTS

| | | | | |
|---|---|---|---|---|
| 7,558,690 | B2 | 7/2009 | Curtius et al. | |
| 8,108,063 | B2 | 1/2012 | Agrawal et al. | |
| 8,648,321 | B2 | 2/2014 | Schenkel et al. | |
| 2001/0043327 | A1* | 11/2001 | Barney | G01J 3/10 356/326 |
| 2003/0019253 | A1* | 1/2003 | Lorenz | D06F 34/18 356/440 |
| 2008/0128001 | A1* | 6/2008 | Kennichi | A47L 15/0021 134/18 |
| 2008/0295257 | A1 | 12/2008 | Bringewatt et al. | |
| 2010/0036795 | A1* | 2/2010 | Busch | G01N 21/359 703/2 |
| 2010/0251780 | A1 | 10/2010 | Im et al. | |
| 2016/0160423 | A1 | 6/2016 | Yoneda et al. | |
| 2017/0176324 | A1* | 6/2017 | Perkins | G01N 21/25 |

FOREIGN PATENT DOCUMENTS

| | | | | |
|---|---|---|---|---|
| EP | 1978144 | A2 | 10/2008 | |
| WO | WO2017220336 | | 12/2017 | |
| WO | WO-2019081014 | A1 * | 5/2019 | D06F 33/37 |
| WO | WO-2019174955 | A1 * | 9/2019 | D06F 34/18 |

OTHER PUBLICATIONS

Gusni, Misniati Binti, PC Based Washing Machine Controller, Universiti Teknikal Malaysia Melaka, Beke, 2009.

* cited by examiner

WASHING APPARATUS INCLUDING CLOUD CONNECTED SPECTROMETER

BACKGROUND

Washing apparatuses, such as laundry washing machines or dishwashers, are used in many single-family and multi-family residential applications to clean clothes and other fabric items or dishes and silverware, respectively. Due to the wide variety of items that these washing apparatuses encounter these apparatuses typically provide a wide variety of user-configurable settings to control various aspects of a wash cycle such as water temperatures and/or amounts, soaking, rinsing, etc. These cycle settings can have an appreciable effect on washing performance, as well as on energy and/or water consumption, so it is generally desirable for the settings used by a washing apparatus to appropriately match the needs of each load washed.

Some washing apparatuses also support user selection of load types, typically based on the soil level of the items contained therein. These manually-selectable load types generally represent specific combinations of settings that are optimized for particular load types so that a user is not required to select individual values for each of the controllable settings of a washing apparatus. However, such manual selection still can lead to suboptimal performance due to, for example, user inattentiveness or lack of understanding. Therefore, a significant need continues to exist in the art for a manner of optimizing the performance of a washing apparatuses for different types of loads, as well as reducing the burden on users when interacting with a washing apparatus.

SUMMARY

The invention addresses these and other problems associated with the art by providing a washing apparatus, system and method that automate the selection of one or more parameters for a wash cycle based in part on spectral data collected by a spectrometer from inside the washing apparatus and analyzed via a remote cloud service.

In some instances, a washing apparatus, including: a housing to house one or more items during a wash cycle performed using one or more fluids; a spectrometer located in the housing and configured to capture spectral data for the one or more items or the one or more fluids; and a controller in communication with the spectrometer that is configured to: transmit the captured spectral data to a remote device; receive, from the remote device, response data generated from the spectral data; and configure one or more parameters for the wash cycle based upon the response data.

In some embodiments, the washing apparatus is a laundry washing machine and the spectrometer is positioned to sense a fluid within a sump of the washing machine. In some such embodiments, the spectrometer is configured to capture a spectral signature of the sensed fluid. In some such embodiments, configuring the one or more parameters of the wash cycle includes configuring at least one of the one or more parameters based upon mineral content of the sensed fluid. In other such embodiments, configuring the one or more parameters of the wash cycle includes configuring at least one of the one or more parameters based upon debris within the sensed fluid.

In other embodiments, the washing apparatus is a laundry washing machine and the spectrometer is positioned to sense a fluid or a fabric within a wash tub of the washing machine. In some such embodiments, configuring the one or more parameters of the wash cycle includes configuring at least one of the one or more parameters based upon the fabric within the wash tub.

In still other embodiments, the washing apparatus is a dishwasher and the spectrometer is positioned to sense a fluid within a sump of the dishwasher. In some such embodiments, configuring the one or more parameters of the wash cycle includes configuring at least one of the one or more parameters based upon debris within the sensed fluid.

In some embodiments, the controller is configured to select a load type from among a plurality of load types based upon the response data. In some embodiments, the one or more parameters include a wash or rinse temperature, a wash or rinse water amount, a detergent type, an amount of detergent, a cycle time, or a number of phase repeats.

In another aspect, a system for sensing and monitoring the contents inside of a washing apparatus to modify a wash cycle includes: a housing to house one or more items during a wash cycle performed using one or more fluids; a spectrometer located within the housing and configured to capture spectral data for the one or more items or the one or more fluids; a remote device configured to analyze the captured spectral data to obtain response data based on the captured spectral data; and a controller in communication with the spectrometer and the remote device, where the controller is configured to: transmit the captured spectral data to the remote device; receive, from the remote device, the response data; and configure one or more parameters for a wash cycle of the washing apparatus based upon the response data.

In some embodiments, the remote device is a remote cloud service that includes a database of possible spectral signatures and the remote cloud service determines, based on comparison with the database of possible spectral signatures and the captured spectral data, chemical composition data. In some such embodiments, the remote cloud service includes a wash parameter selection module that determines the one or more parameters of a wash cycle based on analysis of the spectral data. In other embodiments, the washing apparatus includes a wash parameter selection module that determines the one or more parameters of a wash cycle based on the response data.

In some embodiments, the washing apparatus is a laundry washing machine and the spectrometer is positioned to sense a fluid within a sump of the washing machine, and where configuring the one or more parameters of the wash cycle includes configuring at least one of the one or more parameters based upon mineral content of the sensed fluid. In other embodiments, the washing apparatus is a laundry washing machine and the spectrometer is positioned to sense a fluid within a sump of the washing machine, and where configuring the one or more parameters of the wash cycle includes configuring at least one of the one or more parameters based upon debris within the sensed fluid. In still other embodiments, the washing apparatus is a laundry washing machine and the spectrometer is positioned to sense a fluid or a fabric within a wash tub of the washing machine, and where configuring the one or more parameters of the wash cycle includes configuring at least one of the one or more parameters based upon the fluid or the fabric within the wash tub. In still other embodiments, the washing apparatus is a dishwasher and the spectrometer is positioned to sense a fluid within a sump of the dishwasher, and where configuring the one or more parameters of the wash cycle includes configuring at least one of the one or more parameters based upon debris within the sensed fluid.

In some embodiments, the controller is configured to select a load type from among a plurality of load types based upon the response data.

In yet another aspect, a method of operating a washing apparatus includes: capturing, by a spectrometer located within a housing configured to house one or more items during a wash cycle performed using one or more fluids, spectral data of the fluid or the item contained within the housing; transmitting, by a controller, the spectral data to a remote device for analysis; receiving, by the controller, response data based on the spectral data analyzed by the remote device; and configuring, by the controller, one or more parameters of the wash cycle based upon the response.

In some embodiments, configuring the one or more parameters of the wash cycle includes configuring at least one of the one or more parameters based upon debris within the sensed fluid.

DETAILED DESCRIPTION

Embodiments consistent with the invention may be used to automate the selection of a one or more parameters for a wash cycle of a washing apparatus, such as a laundry washing machine or dishwasher, based upon spectral data collected from inside the washing apparatus and analyzed by a remote cloud service. In particular, in some embodiments consistent with the invention, a spectrometer may be used to collected spectral data from items or fluids contained within the washing apparatus, and the collected spectral data may be analyzed in a remote cloud service in order to determine the minerals, soil, food, fabric, etc. contained therein. One or more wash parameters may then be altered in response to the determination of the minerals, soil, food, fabric, etc. to improve or otherwise optimize washing performance.

A parameter for a wash cycle, in this regard, may include any number of different configurable aspects of a wash cycle performed by a washing apparatus. For example, various parameters of a wash cycle for a laundry washing machine may include, but not be limited to, a wash water temperature, a rinse water temperature, a wash water amount, a rinse water amount, a duration of a wash, rinse, or soak, a number of repeats of a wash, rinse, or soak phase, selection between different rinse operation types such as a spray rinse operation or a deep fill rinse operation, pre-treatment such as soaking over time with a prescribed water temperature, an amount and/or type of detergent, etc. As another example, various parameters of a wash cycle for a dishwasher may include, but not be limited to, the control over one or more settings of the dishwasher, e.g., a wash operation duration, a number of cycles (e.g., rinse, wash, soak, drying cycles), a cycle duration, a wash temperature, a cycle type (e.g., normal, pot scrubber, quick wash, etc.), or a detergent amount (e.g., where an automatic dispenser is present). Other configurations or settings may also be varied based upon the load characteristics, so the invention is not limited to this particular list.

Numerous variations and modifications will be apparent to one of ordinary skill in the art, as will become apparent from the description below. Therefore, the invention is not limited to the specific implementations discussed herein.

Figure 1:
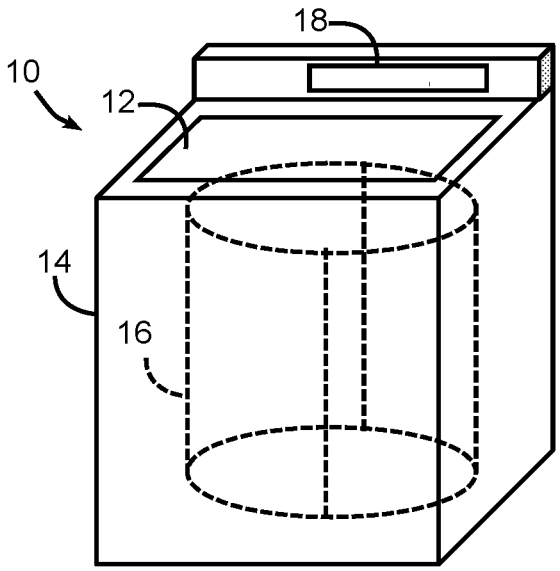
FIG. 1 is a perspective view of a top-load laundry washing machine consistent with some embodiments of the invention.

Turning now to the drawings, wherein like numbers denote like parts throughout the several views, FIG. 1 illustrates a washing apparatus, which in some embodiments may be a laundry washing machine, in which the various technologies and techniques described herein may be implemented. Laundry washing machine 10 is a top-load washing machine, and as such includes a top-mounted door 12 in a cabinet or housing 14 that provides access to a vertically-oriented wash tub 16 housed within the cabinet or housing 14. Door 12 is generally hinged along a side or rear edge and is pivotable between the closed position illustrated in FIG. 1 and an opened position (not shown). When door 12 is in the opened position, clothes and other washable items may be inserted into and removed from wash tub 16 through an opening in the top of cabinet or housing 14. Control over washing machine 10 by a user is generally managed through a control panel 18 disposed on a backsplash and implementing a user interface for the washing machine, and it will be appreciated that in different washing machine designs, control panel 18 may include various types of input and/or output devices, including various knobs, buttons, lights, switches, textual and/or graphical displays, touch screens, etc. through which a user may configure one or more settings and start and stop a wash cycle.

Figure 2:
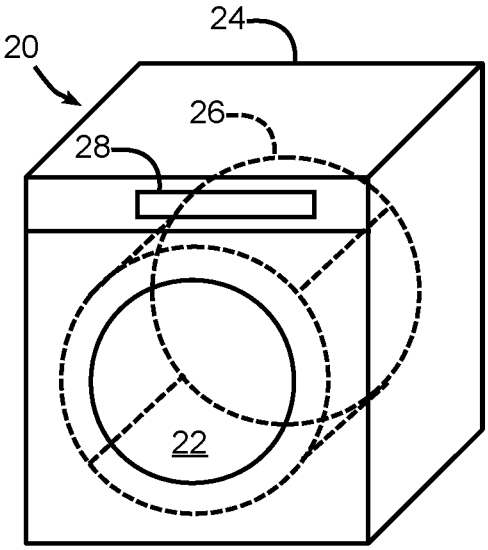
FIG. 2 is a perspective view of a front-load laundry washing machine consistent with some embodiments of the invention.

The embodiments discussed hereinafter will focus on the implementation of the hereinafter-described techniques within a top-load residential laundry washing machine such as laundry washing machine 10, such as the type that may be used in single-family or multi-family dwellings, or in other similar applications. However, it will be appreciated that the herein-described techniques may also be used in connection with other types of laundry washing machines in some embodiments. For example, the herein-described techniques may be used in commercial applications in some embodiments. Moreover, the herein-described techniques may be used in connection with other laundry washing machine configurations. FIG. 2, for example, illustrates a front-load laundry washing machine 20 that includes a front-mounted door 22 in a cabinet or housing 24 that provides access to a horizontally-oriented wash tub 26 housed within the cabinet or housing 24, and that has a control panel 28 positioned towards the front of the machine rather than the rear of the machine as is typically the case with a top-load laundry washing machine. Implementation of the herein-described techniques within a front-load laundry washing machine would be well within the abilities of one of ordinary skill in the art having the benefit of the instant disclosure, so the invention is not limited to the top-load implementation discussed further herein.

Figure 3:
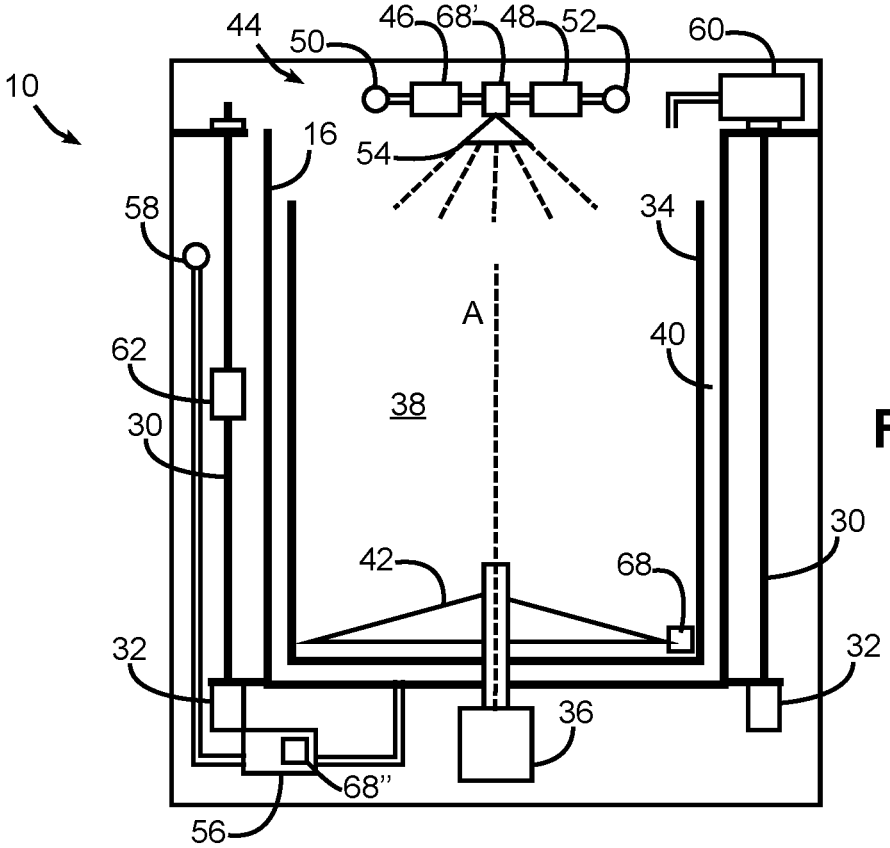
FIG. 3 is a functional vertical section of the laundry washing machine of FIG. 1.

FIG. 3 functionally illustrates a number of components in laundry washing machine 10 as is typical of many washing machine designs. For example, wash tub 16 may be vertically oriented, generally cylindrical in shape, opened to the top and capable of retaining water and/or wash liquor dispensed into the washing machine. Wash tub 16 may be supported by a suspension system such as a set of support rods 30 with corresponding vibration dampening springs 32.

Disposed within wash tub 16 is a wash basket 34 that is rotatable about a generally vertical axis A by a drive system 36. Wash basket 34 is generally perforated or otherwise provides fluid communication between an interior 38 of the wash basket 34 and a space 40 between wash basket 34 and wash tub 16. Drive system 36 may include, for example, an electric motor and a transmission and/or clutch for selectively rotating the wash basket 34. In some embodiments, drive system 36 may be a direct drive system, whereas in other embodiments, a belt or chain drive system may be used.

In addition, in some embodiments, an agitator 42 such as an impeller, auger or other agitation element may be disposed in the interior 38 of wash basket 34 to agitate items within wash basket 34 during a washing operation. Agitator 42 may be driven by drive system 36, e.g., for rotation about the same axis as wash basket 34, and a transmission and/or clutch within drive system 36 may be used to selectively rotate agitator 42. In other embodiments, separate drive systems may be used to rotate wash basket 34 and agitator 42.

A water inlet 44 may be provided to dispense water into wash tub 16. In some embodiments, for example, hot and cold valves 46, 48 may be coupled to external hot and cold water supplies through hot and cold inlets 50, 52, and may output to one or more nozzles 54 to dispense water of varying temperatures into wash tub 16. In addition, a pump system 56, e.g., including a pump and an electric motor, may be coupled between a low point, bottom or sump in wash tub 16 and an outlet 58 to discharge greywater from wash tub 16.

In some embodiments, laundry washing machine 10 may also include a dispensing system 60 configured to dispense detergent, fabric softener, stain removing compositions, and/or other wash-related products into wash tub 16. Dispensing system 60 may be configured, in some embodiments, to dispense controlled amounts of wash-related products, e.g., as may be stored in a reservoir (not shown) in laundry washing machine 10. In other embodiments, dispensing system 60 may be used to time the dispensing of wash-related products that have been manually placed in one or more reservoirs in the machine immediately prior to initiating a wash cycle. Dispensing system 60 may also, in some embodiments, receive and mix water with wash-related products to form one or more wash liquors that are dispensed into wash tub 16. In still other embodiments, no dispensing system may be provided, and a user may simply add wash-related products directly to the wash tub prior to initiating a wash cycle.

It will be appreciated that the particular components and configuration illustrated in FIG. 3 is typical of a number of common laundry washing machine designs. Nonetheless, a wide variety of other components and configurations are used in other laundry washing machine designs, and it will be appreciated that the herein-described functionality generally may be implemented in connection with these other designs, so the invention is not limited to the particular components and configuration illustrated in FIG. 3.

Further, in some embodiments, in order to configure one or more parameters of a wash cycle, laundry washing machine 10 may include a weight sensor and/or a spectrometer 68. A weight sensor may be used to generate a signal that varies based in part on the mass or weight of the contents of wash tub 16. In the illustrated embodiment, for example, a weight sensor may be implemented in laundry washing machine 10 using one or more load cells 62 that support wash tub 16 on one or more corresponding support rods 30. Each load cell 62 may be an electro-mechanical sensor that outputs a signal that varies with a displacement based on load or weight, and thus outputs a signal that varies with the weight of the contents of wash tub 16. Multiple load cells 62 may be used in some embodiments, while in other embodiments, other types of transducers or sensors that generate a signal that varies with applied force, e.g., strain gauges, may be used. Furthermore, while load cells 62 are illustrated as supporting wash tub 16 on support rods 30, the load cells, or other appropriate transducers or sensors, may be positioned elsewhere in a laundry washing machine to generate one or more signals that vary in response to the weight of the contents of wash tub 16. In some embodiments, for example, transducers may be used to support an entire load washing machine, e.g., one or more feet of a machine. Other types and/or locations of transducers suitable for generating a signal that varies with the weight of the contents of a wash tub will be apparent to one of ordinary skill in the art having the benefit of the instant disclosure. In addition, in some embodiments, a weight sensor may also be used for vibration sensing purposes, e.g., to detect excessive vibrations resulting from an out-of-balance load. In other embodiments, however, no vibration sensing may be used, while in other embodiments, separate sensors may be used to sense vibrations.

A spectrometer 68 may be positioned within the housing 14 of the laundry washing machine 10 and may be configured to capture spectral data for one or more items (e.g. fabrics) or the fluid within the laundry washing machine 10. In some instances, the spectrometer 68 may be positioned within the wash tub 16 and may capture spectral data of one or more items (e.g. fabrics or stains on the fabrics) or fluid within the wash tub 16. In other instances, the spectrometer 68' may be position near the top of the wash tub 16. When positioned within the wash tub 16 or drum of the laundry washing machine 10, the spectrometer 68 may be used (see FIG. 5) to capture spectral data (e.g. a spectral signature, see 508 in FIG. 5) about the fabric contained within the wash tub 16, which may include fabric type (e.g. cotton, polyester, nylon, etc.) and/or the type of stains contained on the fabric (e.g. oil, foods, grass, etc.). In still other instances, the spectrometer 68" may capture spectral data about the fluid within the wash tub 16, which may, for example, including information such as the mineral content of the fluid or the debris within the fluid.

In other instances, the spectrometer 68 may be located with the pump system 56 or sump of the laundry washing machine 10. When positioned within the sump, the spectrometer 68 may similarly be used (as described with reference to FIG. 5) to capture spectral data about the fluid being discharged from the wash tub 16. This spectral data may, for example, include information such as the mineral content of the fluid or the debris within the fluid.

One or more parameters of the wash cycle may be configured based on the analyzed spectral data. As discussed herein, the spectrometer 68 may measure a change over a range of incident wavelengths (or, in some instances, at a specific wavelength) that results as light passes through the object (e.g. fabric) or fluid. This produces spectral data, which, in some instances, may be in the form of a spectral signature, and which can be compared to databases of known objects and substances in order to reveal their composition. Various parameters of the wash cycle may be configured based on this compositional information. For example, where there is organic debris (e.g. grass, blood, wine, non-greasy food, etc.) in the fluid a particular stain treatment or presoak may be added. As another example, where a particular fabric type is determined to be in the wash tub 16, the water temperature may be adjusted accordingly.

Although a weight sensor and spectrometer are specifically discussed herein, this is not to be understood as limiting, as additional sensors may also be incorporated into a laundry washing machine 10. For example, in some embodiments, sensors may be used to measure water temperature at various points in the wash cycle. Other sensors may also be incorporated in the laundry washing machine to measure additional characteristics.

Figure 5:
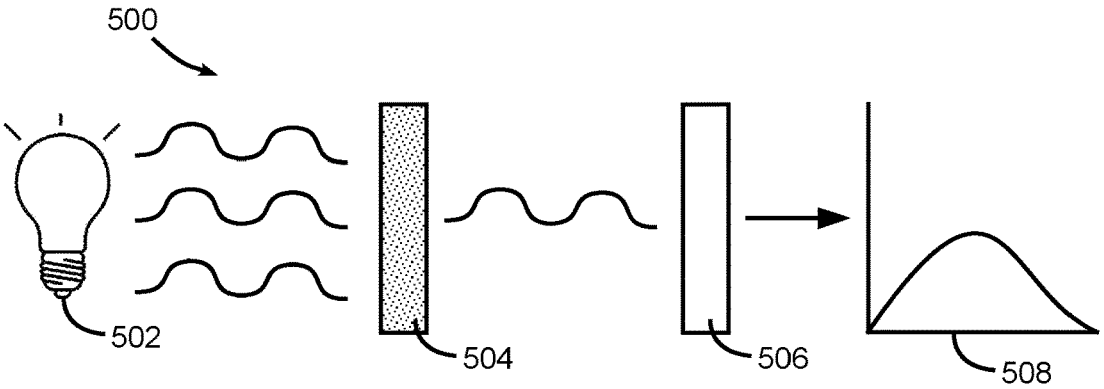
FIG. 5 is an exemplary schematic illustrating a general process for obtaining a spectral signature from a fluid or item using a spectrometer in a manner consistent with the invention.

Referring now to FIG. 5, which illustrates an exemplary schematic of a spectrometer 500 that may be used herein. A spectrometer may be used to determine information about, including the identity of, various objects or substances through analysis of the object or substance's light properties. In particular, spectrometers may utilize optical dispersion and measure properties of light over a specific portion of the electromagnetic spectrum, which may then be used to identify the material(s) contained in the sample. As illustrated in FIG. 5, it is the intensity of the light that is measured, but spectrometers may also measure the polarization state. A light source 502 emits various wavelengths of light. This light may be reflected off, absorbed by, or transmitted through a sample 504 (e.g. a fluid, object, etc.). The way this light changes during its interaction with the sample 504 is characteristic of the sample. The detector 506 portion of the spectrometer 500 measures this change over a range of incident wavelengths (or, in some instances, at a specific wavelength) and may produce a spectral signature 508 that may be compared to databases of known objects and substances in order to reveal the composition the sample 504.

Figure 4:
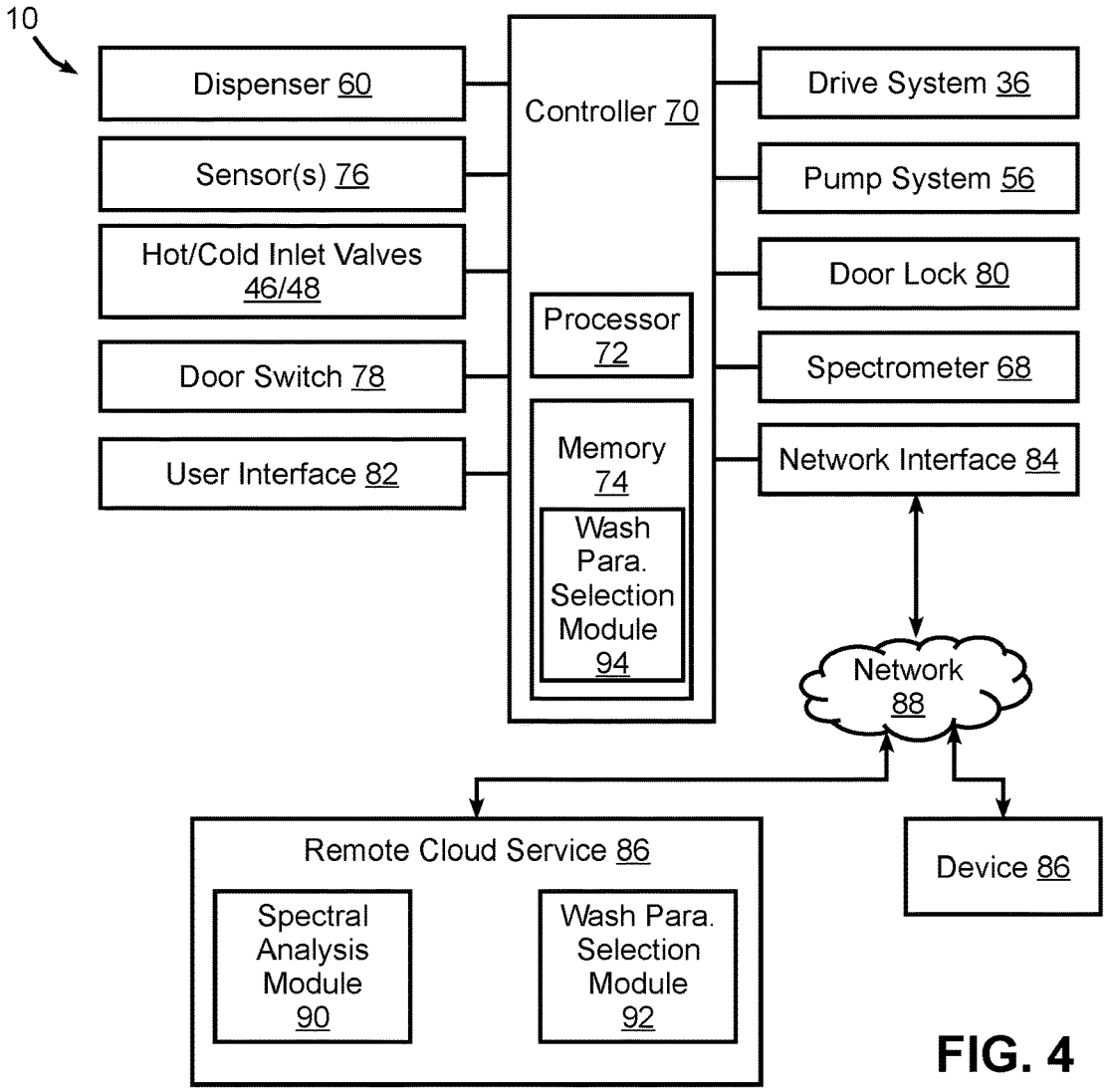
FIG. 4 is a block diagram of an example control system for the laundry washing machine of FIG. 1.

Now turning to FIG. 4, laundry washing machine 10 may be under the control of a controller 70 that receives inputs from a number of components and drives a number of components in response thereto. Controller 70 may, for example, include one or more processors and a memory (not shown) within which may be stored program code for execution by the one or more processors 72. The memory may be embedded in controller 70, but may also be considered to include volatile and/or non-volatile memories, cache memories, flash memories, programmable read-only memories, read-only memories, etc., as well as memory storage physically located elsewhere from controller 70, e.g., in a mass storage device or on a remote computer interfaced with controller 70.

As shown in FIG. 4, controller 70 may be interfaced with various components, including the aforementioned drive system 36, hot/cold inlet valves 46, 48, pump system 56, spectrometer 68, various sensors 76 and so on. In addition, controller 70 may be interfaced with additional components such as a door switch 78 that detects whether door 12 is in an open or closed position and a door lock 80 that selectively locks door 12 in a closed position. Moreover, controller 70 may be coupled to a user interface 82 including various input/output devices such as knobs, dials, sliders, switches, buttons, lights, textual and/or graphics displays, touch screen displays, speakers, image capture devices, microphones, etc. for receiving input from and communicating with a user. In some embodiments, controller 70 may also be coupled to one or more network interfaces 84, e.g., for interfacing with one or more remote devices 86 via wired and/or wireless networks 88 such as Ethernet, Bluetooth, NFC, cellular and other suitable networks.

In an example, as illustrated in FIG. 4, one of the remote devices 86 may be a remote cloud service coupled in network 88. In some instances, the remote cloud service may include a spectral analysis module 90, which may analyze the captured spectral data (e.g. a spectral signature, see 508 in FIG. 5) from the fabric or fluid contained within the wash tub. The spectral analysis module 90 may include a database of spectral signatures of possible chemical components, so that the captured spectral data may be assessed in comparison with that database in order to determine the likely identity of the various minerals in the fluid, debris in the fluid (e.g. food items), and/or items (e.g. fabrics, stains on fabrics, etc.).

The remote cloud service 86 may also, in some instances, include a wash parameter selection module 92, which may determine one or more parameters of a wash cycle based on the analysis of the spectral data. These selected wash parameters may be transmitted back to controller 70 via network 88 and network interface 84. In other instances, a wash parameter selection module 94 may be located locally within the memory 74 of the laundry washing machine 10.

Additional components may also be interfaced with controller 70, as will be appreciated by those of ordinary skill having the benefit of the instant disclosure. Moreover, in some embodiments, at least a portion of controller 70 may be implemented externally from a laundry washing machine, e.g., within a mobile device, a cloud computing environment, etc., such that at least a portion of the functionality described herein is implemented within the portion of the controller that is externally implemented.

In some embodiments, controller 70 may operate under the control of an operating system and may execute or otherwise rely upon various computer software applications, components, programs, objects, modules, data structures, etc. In addition, controller 70 may also incorporate hardware logic to implement some or all of the functionality disclosed herein. Further, in some embodiments, the sequences of operations performed by controller 70 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

FIG. 4 illustrates an example control system for a laundry washing machine 10 described herein; however, it is to be understood that the location of the controller is not limited to the laundry washing machine 10 itself. In some embodiments, the controller may be disposed in a mobile computing device, server, or other device wirelessly connected to the laundry washing machine 10. Moreover, multiple devices, e.g., an embedded device in a laundry washing machine and a device networked thereto such as a mobile computing device may collectively implement the functions of controller 70, with different operations performed by the different devices alone or jointly with one another.

Figure 6:
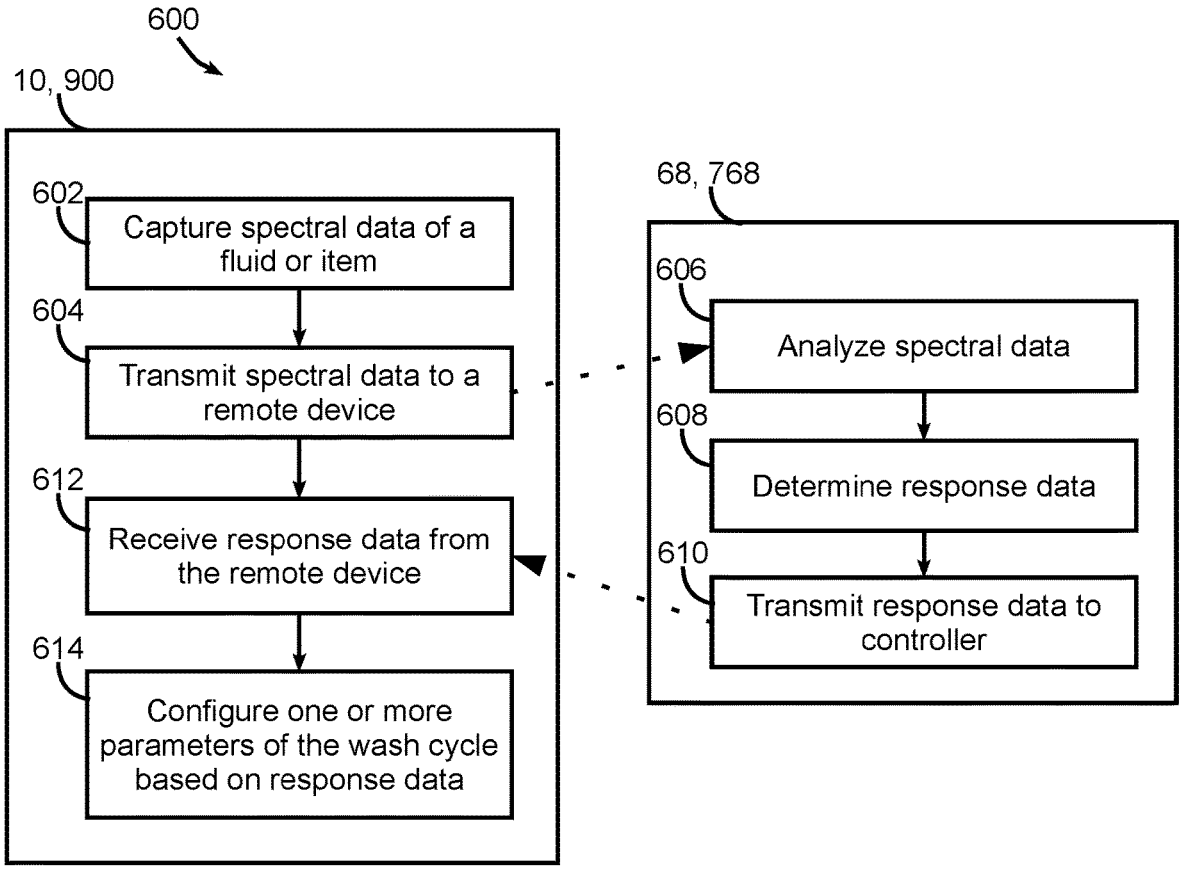
FIG. 6 is a flowchart illustrating an example sequence of operations for operating a washing apparatus, such as the laundry washing machine of FIG. 1 or the dishwasher or FIG. 7.

Now turning to FIG. 6, an embodiment of a method 600 for operating a washing apparatus, such as laundry washing machine 10 or dishwasher 700 (described below) and configuring of one or more parameters of the wash cycle based on response data generated from the spectrometer is illustrated. It will be appreciated that wash cycles may vary in a number of respects that may be configured by method 600, or other exemplary methods disclosed herein. For example, for a laundry washing machine 10, additional phases, such as a pre-soak phase or stain treatment phase may be included in some wash cycles, and moreover, some phases may be repeated, e.g., including multiple rinse and/or spin phases. Each phase may also have a number of different operational settings that may be varied for different types of loads, e.g., different times or durations, different water temperatures, different agitation speeds or strokes, different rinse operation types, different spin speeds, different water amounts, different wash product amounts, etc. For example, for a dishwasher 700, the wash cycle parameters may include, but not be limited to, the control over one or more settings of the dishwasher, e.g., a wash operation duration, a number of cycles (e.g., rinse, wash, soak, drying cycles), a cycle duration, a wash temperature, a cycle type (e.g., normal, pot scrubber, quick wash, etc.), or a detergent amount (e.g., where an automatic dispenser is present).

In embodiments consistent with the invention, the operation of washing apparatus (e.g. a laundry washing machine 10 or a dishwasher 700) may include, in block 602, using a spectrometer contained within the housing to capture spectral data of the fluid or item(s) contained within the washing apparatus (e.g. laundry washing machine 10 or dishwasher 700). In some instances, the spectral data may include one or more spectral signatures, or the specific combination of emitted, reflected or absorbed electromagnetic radiation at varying wavelengths, corresponding to the one or more items or fluids in the washing apparatus (e.g. laundry washing machine 10 or dishwasher 700). As described herein, the spectrometer may be positioned so as to capture spectral data of the fluid within the sump, or the spectrometer may be positioned so as to capture spectral data of fluid or various items (e.g. fabric) contained within the wash tub.

Next, in block 604, a controller transmits the captured spectral data to a remote cloud service in a remote device to be analyzed. In some instances, this transmission may be wireless (e.g. over Ethernet, Bluetooth, NFC, cellular, and/or other suitable networks); while in other instances, this transmission may be wired.

In block 606, the cloud service in the remote device may analyze the captured spectral data in order to determine the chemical composition of the fluids and/or items represented by the spectral data. In some instances, the remote device may have, or have access to, a database of spectral signatures of possible chemical components. In such instances, the remote device may compare the captured spectral to the database of spectral signatures to obtain chemical composition data and determine the identity of the various minerals in the fluid, debris in the fluid (e.g. food items), and/or items (e.g. fabrics, stains on fabrics, etc.). In block 608, the remote device may determine the response data. In some instances, the response data may be the chemical composition data, which may then be returned to the washing apparatus so that the washing apparatus can locally determine one or more commands for configuring the wash cycle (e.g., using block 92 of FIG. 4). In other instances, the remote device may process the chemical composition data and determine one or more commands for configuring the wash cycle of the laundry washing machine (e.g., using block 94 of FIG. 4; in such instances, the response data may be the one or commands for configuring the wash cycle. In block 610, the remote device may transmit the response data to the controller. In some instances, this transmission may be wireless (e.g. over Ethernet, Bluetooth, NFC, cellular, and/or other suitable networks); while in other instances, this transmission may be wired.

In block 612, the controller may receive the response data transmitted by the remote device in block 610. In block 614, the controller may configure one or more parameters of the wash cycle based upon the response data. As described previously, a parameter for a wash cycle of a laundry washing machine 10, in this regard, may include any number of different configurable aspects of a wash cycle performed by a laundry washing machine including, but not limited to, a wash water temperature, a rinse water temperature, a wash water amount, a rinse water amount, a speed or stroke of agitation during washing and/or rinsing, a spin speed, whether or not agitation is used during washing and/or rinsing, a duration of a wash, rinse, soak, or spin phase of a wash cycle, a number of repeats of a wash, rinse, soak or spin phase, selection between different rinse operation types such as a spray rinse operation or a deep fill rinse operation, pre-treatment such as soaking over time with a prescribed water temperature and specific agitation stroke, etc. In some embodiments, either a user selection or automated selection of a load type (e.g. delicates, colors or whites, or the like) may result in the selection of one or more parameters corresponding to a wash cycle configured for that load type. A parameter for a wash cycle of a dishwasher 700 may include, but not be limited to, the control over one or more settings of the dishwasher, e.g., a wash operation duration, a number of cycles (e.g., rinse, wash, soak, drying cycles), a cycle duration, a wash temperature, a cycle type (e.g., normal, pot scrubber, quick wash, etc.), or a detergent amount (e.g., where an automatic dispenser is present).

Figure 7:
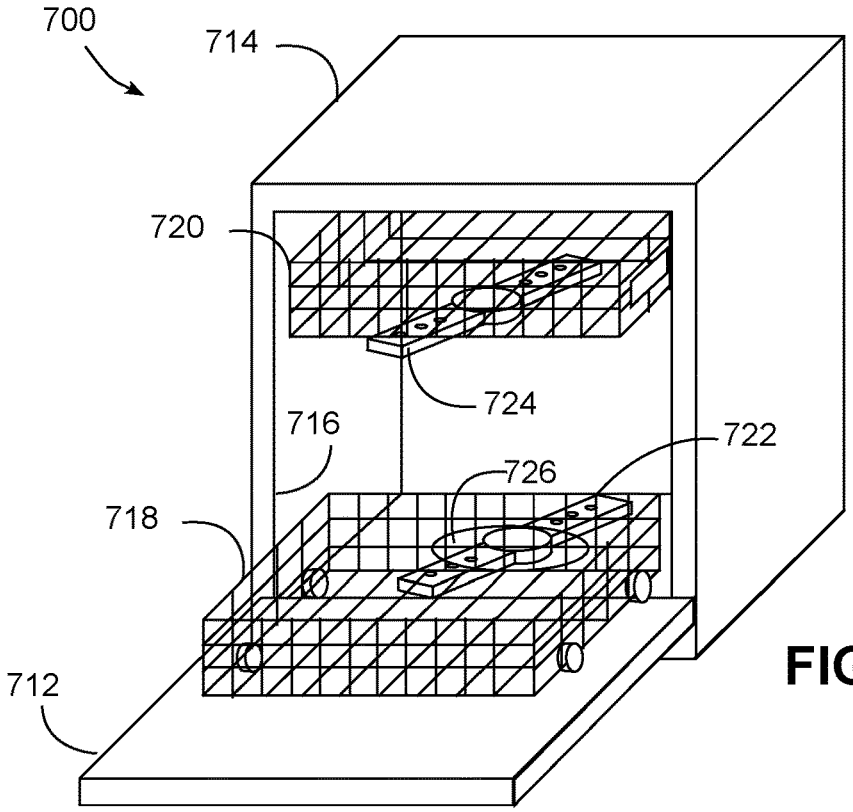
FIG. 7 is a perspective view of a dishwasher consistent with some embodiments of the invention.
Figure 8:
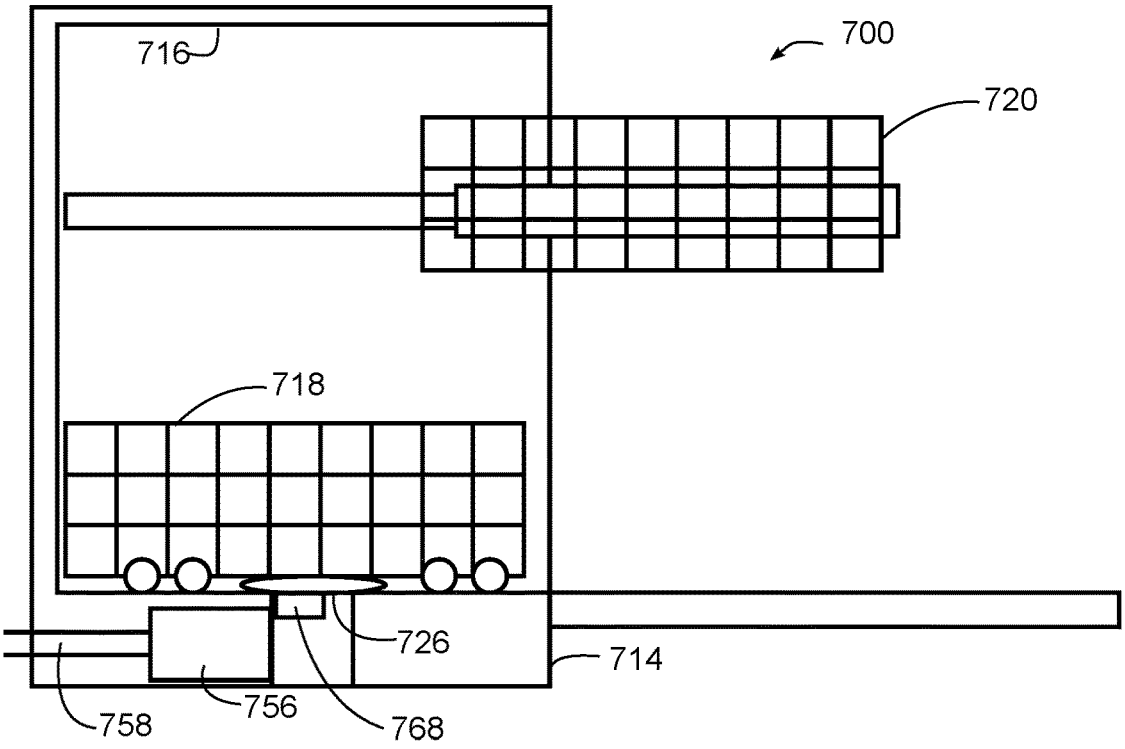
FIG. 8 is a functional side view of the dishwasher of FIG. 7.

In some embodiments, the washing apparatus may be a dishwasher, an example of which is illustrated in FIGS. 7 and 8. FIG. 7 illustrates a perspective view of an example dishwasher 700 in which the various technologies and techniques described herein may be implemented. Dishwasher 700 is a residential-type built-in dishwasher, and as such includes a front-mounted door 712 that provides access to a wash tub 716 housed within the cabinet or housing 714. Door 712 is generally hinged along a bottom edge and is pivotable between the opened position illustrated in FIG. 7 and a closed position (not shown). When door 712 is in the opened position, access is provided to one or more sliding racks, e.g., lower rack 718 and upper rack 720, within which various utensils are placed for washing. Lower rack 718 may be supported on rollers, while upper rack 720 may be supported on side rails, and each rack is movable between loading (extended) and washing (retracted) positions along a substantially horizontal direction. One or more rotating spray arms, e.g., lower spray arm 722 and upper spray arm 724, may also be provided to direct a spray of wash fluid onto utensils, e.g., upwardly into the respective rack 718, 720 under which is spray arm is disposed. During use, this water may then drain into the sump 726 of the dishwasher. In some instances, the sump 726 may additionally include a filter and/or cover (not illustrated).

FIG. 8 illustrates a functional side view of dishwasher 700. In this figure, the upper rack 720 is illustrated in its extended position, while lower rack 718 is illustrated in its operative position. As is best illustrated in this view, dishwasher 700 includes a wash tub 716 housed within the cabinet or housing 714. A pump system 756, e.g., including a pump and an electric motor, may be coupled between a low point, bottom or sump 726 in wash tub 716 and an outlet 758 to discharge greywater from wash tub 716. A spectrometer 768 may be positioned within the housing 714 of the dishwasher 700 and may be configured to capture spectral data for the fluid within the dishwasher. The spectrometer 768 may be positioned to sense a fluid within a sump 726 of the dishwasher. In some instances, this may be within the sump 726 itself, as illustrated in FIG. 8; in other instances, this may be within a tube or pipe leading to or from the sump 726. As described previously herein, the spectrometer may be used (as described with reference to FIG. 5) to capture spectral data (e.g. a spectral signature, see 508 in FIG. 5) about the fluid being discharged from the wash tub 716 into the sump 726. This may, in some instances, include information such as the mineral content of the fluid, or the debris (e.g. types or amount of food) within the fluid.

One or more parameters of the wash cycle may be configured based on the analyzed spectral data. As discussed herein, the spectrometer 768 may measure a change over a range of incident wavelengths (or, in some instances, at a specific wavelength) that results as light passes through the fluid. This produces spectral data, which, in some instances, may be in the form of a spectral signature, can be compared to databases of known objects and substances in order to reveal the composition of the fluid, as well as debris or minerals contained therein. Various parameters of the wash cycle may be configured based on this compositional information. For example, these parameters may include the control over one or more settings of the dishwasher, e.g., a wash operation duration, a number of cycles (e.g., rinse, wash, soak, drying cycles), a cycle duration, a wash temperature, a cycle type (e.g., normal, pot scrubber, quick wash, etc.), or a detergent amount (e.g., where an automatic dispenser is present). Other configurations or settings may also be varied based upon the load characteristics, so the invention is not limited to this particular list.

The embodiments discussed hereinafter will focus on the implementation of the hereinafter-described techniques within a hinged-door dishwasher. However, it will be appreciated that the herein-described techniques may also be used in connection with other types of dishwashers in some embodiments. For example, the herein-described techniques may be used in commercial applications in some embodiments. Moreover, at least some of the herein-described techniques may be used in connection with other dishwasher configurations, including dishwashers utilizing sliding drawers, whereby the racks may be integrated with the drawers.

Figure 9:
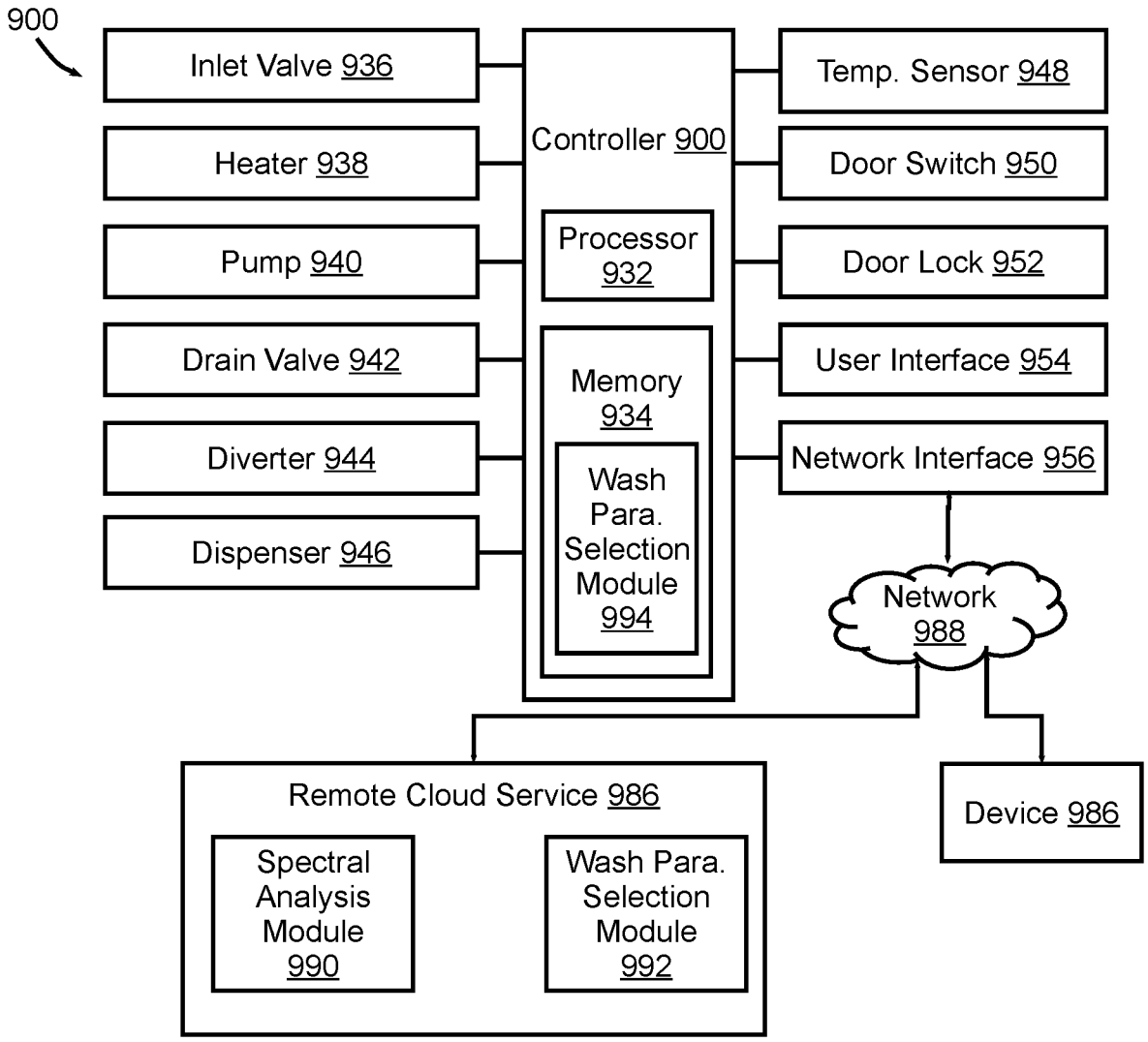
FIG. 9 is a block diagram of an example control system for the dishwasher of FIG. 7.

Now turning to FIG. 9, similar to the laundry washing machine embodiment of the washing apparatus, dishwasher 700 may be under the control of a controller 900 that receives inputs from a number of components and drives a number of components in response thereto. Controller 900 may, for example, include one or more processors 932 and a memory 934 within which may be stored program code for execution by the one or more processors. The memory may be embedded in controller 900, but may also be considered to include volatile and/or non-volatile memories, cache memories, flash memories, programmable read-only memories, read-only memories, etc., as well as memory storage physically located elsewhere from controller 900, e.g., in a mass storage device or on a remote computer interfaced with controller 900.

As shown in FIG. 9, controller 900 may be interfaced with various components, including an inlet valve 936 that is coupled to a water source to introduce water into wash tub 716, which when combined with detergent, rinse agent and/or other additives, forms various fluids. Controller may also be coupled to a heater 938 that heats fluids, a pump 940 that recirculates fluid within the wash tub by pumping fluid to the wash arms and other spray devices in the dishwasher, a drain valve 942 that is coupled to a drain to direct fluids out of the dishwasher, and a diverter 944 that controls the routing of pumped fluid to different wash arms and/or other sprayers during a wash cycle. In some embodiments, a single pump 940 may be used, and drain valve 942 may be configured to direct pumped fluid either to a drain or to the diverter 944 such that pump 940 is used both to drain fluid from the dishwasher and to recirculate fluid throughout the dishwasher during a wash cycle. In other embodiments, separate pumps may be used for draining the dishwasher and recirculating fluid. Diverter 944 in some embodiments may be a passive diverter that automatically sequences between different outlets, while in some embodiments diverter 944 may be a powered diverter that is controllable to route fluid to specific outlets on demand. Generally, pump 940 may be considered to be a fluid supply in some embodiments as pump 940 supplies a pressurized source of fluid to diverter 944 for distribution to one or more spray arms and/or sprayers.

Controller 900 may also be coupled to a dispenser (not shown) to trigger the dispensing of detergent 946 and/or rinse agent into the wash tube at appropriate points during a wash cycle. Additional sensors and actuators may also be used in some embodiments, including a temperature sensor 948 to determine a fluid temperature, a door switch 950 to determine when door 712 is latched, and a door lock 952 to prevent the door from being opened during a wash cycle. Moreover, controller 900 may be coupled to a user interface 954 including various input/output devices such as knobs, dials, sliders, switches, buttons, lights, textual and/or graphics displays, touch screen displays, speakers, image capture devices, microphones, etc. for receiving input from and communicating with a user. The controller 900 may also be connected to the spectrometer 768 described previously and may receive spectral data captured by the spectrometer 768. In some embodiments, controller 900 may also be coupled to one or more network interfaces 956, e.g., for interfacing with one or more remote devices 986 via wired and/or wireless networks 988 such as Ethernet, Bluetooth, NFC, cellular and other suitable networks. Additional components may also be interfaced with controller 900, as will be appreciated by those of ordinary skill having the benefit of the instant disclosure.

In an example, as illustrated in FIG. 9, one of the remote devices 986 may be a remote cloud service coupled in network 988. In some instances, the remote cloud service may include a spectral analysis module 990, which may analyze the captured spectral data (e.g. a spectral signature, see 508 in FIG. 5) from fluid contained within the housing or sump of the dishwasher. The spectral analysis module 990 may include a database of spectral signatures of possible chemical components, so that the captured spectral data may be assessed in comparison with that database in order to determine the likely identity of the various minerals or debris in the fluid (e.g. food items).

The remote cloud service 986 may also, in some instances, include a wash parameter selection module 992, which may determine one or more parameters of a wash cycle based on the analysis of the spectral data. These selected wash parameters may be transmitted back to controller 900 via network 988 and network interface 956 In other instances, a wash parameter selection module 994 may be located locally within the memory 934 of the dishwasher 700.

Moreover, in some embodiments, at least a portion of controller 900 may be implemented externally from a dishwasher, e.g., within a mobile device, a cloud computing environment, etc., such that at least a portion of the functionality described herein is implemented within the portion of the controller that is externally implemented. In some embodiments, controller 900 may operate under the control of an operating system and may execute or otherwise rely upon various computer software applications, components, programs, objects, modules, data structures, etc. In addition, controller 900 may also incorporate hardware logic to implement some or all of the functionality disclosed herein. Further, in some embodiments, the sequences of operations performed by controller 900 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein. Returning now to FIG. 6, the method 600 for operating a washing apparatus and configuring of one or more parameters of the wash cycle based on response data generated from the spectrometer may be used as described previously when the washing apparatus is a dishwasher 700.

Various additional modifications may be made to the illustrated embodiments consistent with the invention. Therefore, the invention lies in the claims hereinafter appended.

What is claimed is:

1. A washing apparatus, comprising:

a housing configured to house one or more items during a wash cycle performed using one or more fluids;

a spectrometer disposed within a sump of the washing apparatus and configured to capture spectral data for the one or more items or the one or more fluids, wherein the spectral data comprises a spectral signature of the one or more items or the one or more fluids; and a controller in communication with the spectrometer and configured to:

transmit the captured spectral data to a remote device, wherein the remote device is a remote cloud service that includes a database of possible spectral signatures and that is configured to determine, based on a comparison with the database of possible spectral signatures, chemical composition data, receive, from the remote device, response data generated from the spectral data, wherein the response data is determined by the remote device based on a comparison of the spectral signature with the database of possible spectral signatures, and configure one or more parameters for the wash cycle based upon the response data;

wherein the spectral data further comprises combination of emitted, reflected or absorbed electromagnetic radiation at varying wavelengths corresponding to the one or more items or the one or more fluids;

wherein the spectral signature comprises a change of optical character over a range of incident wavelengths when light passes through the one or more items or the one or more fluids.

2. The washing apparatus of claim 1, wherein the washing apparatus is a laundry washing machine.

3. The washing apparatus of claim 2, wherein configuring the one or more parameters of the wash cycle includes configuring at least one of the one or more parameters based upon mineral content of the one or more fluids.

4. The washing apparatus of claim 2, wherein configuring the one or more parameters of the wash cycle includes configuring at least one of the one or more parameters based upon debris within the one or more fluids.

5. The washing apparatus of claim 1, wherein the washing apparatus is a dishwasher.

6. The washing apparatus of claim 5, wherein configuring the one or more parameters of the wash cycle includes configuring at least one of the one or more parameters based upon debris within the one or more fluids.

7. The washing apparatus of claim 1, wherein the controller is configured to select a load type from among a plurality of load types based upon the response data.

8. The washing apparatus of claim 1, wherein the one or more parameters include a wash or rinse temperature, a wash or rinse water amount, a detergent type, an amount of detergent, a cycle time, or a number of phase repeats.

9. The washing apparatus of claim 1, wherein the spectral data includes information indicating a mineral content of the one or more fluids.

10. A system for sensing and monitoring the contents inside of a washing apparatus to modify a wash cycle, comprising:

a housing configured to house one or more items during a wash cycle performed using one or more fluids;

a spectrometer disposed within a sump of the washing apparatus and configured to capture spectral data for the one or more fluids, wherein the spectral data comprises a spectral signature of the one or more fluids;

a remote device configured to analyze the captured spectral data to obtain response data based on the captured spectral data; and a controller in communication with the spectrometer and the remote device, wherein the controller is configured to:

transmit the captured spectral data to the remote device, receive, from the remote device, the response data, and configure one or more parameters for a wash cycle of the washing apparatus based upon the response data;

wherein the remote device is a remote cloud service that includes a database of possible spectral signatures and the remote cloud service determines, based on comparison with the database of possible spectral signatures and the captured spectral data, chemical composition data wherein the spectral data further comprises combination of emitted, reflected or absorbed electromagnetic radiation at varying wavelengths corresponding to the one or more fluids;

wherein the spectral signature comprises a change of optical character over a range of incident wavelengths when light passes through the one or more fluids.

11. The system of claim 10, wherein the remote cloud service includes a wash parameter selection module that determines the one or more parameters of a wash cycle based on analysis of the spectral data.

12. The system of claim 10, wherein the washing apparatus includes a wash parameter selection module that determines the one or more parameters of a wash cycle based on the response data.

13. The system of claim 10, wherein the washing apparatus is a laundry washing machine and wherein configuring the one or more parameters of the wash cycle includes configuring at least one of the one or more parameters based upon mineral content of the one or more fluids.

14. The system of claim 10, wherein the washing apparatus is a laundry washing machine and the spectrometer is positioned to sense a fluid within a sump of the washing machine and wherein configuring the one or more parameters of the wash cycle includes configuring at least one of the one or more parameters based upon debris within the one or more fluids.

15. The system of claim 10, wherein the washing apparatus is a laundry washing machine.

16. The system of claim 10, wherein the washing apparatus is a dishwasher and wherein configuring the one or more parameters of the wash cycle includes configuring at least one of the one or more parameters based upon debris within the sensed fluid.

17. The system of claim 10, wherein the controller is configured to select a load type from among a plurality of load types based upon the response data.

* * * * *